United States Patent [19]

Phillips et al.

[11] Patent Number: 4,945,286

[45] Date of Patent: Jul. 31, 1990

[54] MICROCHANNEL PLATES FORMED WITH DEPOSITION USING NON-REACTIVE GAS

[75] Inventors: John L. Phillips, South Croydon; Robert P. Ball, London, both of Great Britain

[73] Assignee: U.S. Philips Corporation, New York, N.Y.

[21] Appl. No.: 239,711

[22] Filed: Sep. 2, 1988

[30] Foreign Application Priority Data

Dec. 9, 1987 [GB] United Kingdom ..... 8728760

[51] Int. Cl.[5] ..... H01J 9/12; H01J 1/32; H01J 43/10

[52] U.S. Cl. ..... 313/105 CM; 313/103 CM; 427/123; 427/126.1; 427/126.6

[58] Field of Search ..... 313/528, 103 CM, 105 CM; 427/69, 78, 77, 123, 124, 126.6, 126.1

[56] References Cited

U.S. PATENT DOCUMENTS

| | | | |
|---|---|---|---|
| 3,634,712 | 1/1972 | Orthuber | 313/105 CM |
| 3,974,411 | 8/1976 | Faulkner et al. | 313/105 CM |
| 4,099,079 | 7/1978 | Knapp | 313/103 CM |

*Primary Examiner*—Kenneth Wieder
*Attorney, Agent, or Firm*—Paul R. Miller

[57] ABSTRACT

A method is provided for depositing a conducting electrode on the output face of a microchannel plate and into the output end of each channel. The electrode is vapor deposited by a method which ensures that the material impinges on the output face from random angles relative to the axis of each channel. A layer (10) of tapering thickness is formed down each channel. When used in an image intensifier tube, for example, the output beam of electrons from each channel is more collimated and the resolution of the tube is improved.

22 Claims, 1 Drawing Sheet

MICROCHANNEL PLATES FORMED WITH DEPOSITION USING NON-REACTIVE GAS

DESCRIPTION

Figure 1:
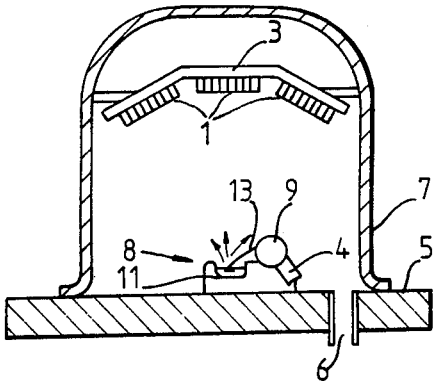

The invention relates to methods of manufacturing microchannel plates and in particular to methods of providing an output electrode on a microchannel plate comprising depositing a conducting electrode material as a layer onto an output face of the microchannel plate and into the output end of each channel.

The invention further relates to a microchannel plate and to image intensifiers and cathode ray tubes including a microchannel plate.

Since the middle 1960's it has been accepted practice in the art of channel plate manufacture to evaporate a metal output electrode onto the output face of the channel plate in high vacuum and to arrange an offset of the metal vapor source relative to the channel plate and to rotate the channel plate in its own plane so that the metal penetrates as a layer of substantially constant thickness down to a depth of two channel diameters where the layer terminates abruptly For brevity, this practice will be referred to herein as geometric evaporation.

It is known from British Patent Specification No. 1,064,074 to provide such a conducting layer by geometric evaporation on the output face of a glass microchannel plate and that the penetration of the layer down into the output end of each channel has the effect of improving the resolution of an image transmitted by the channel plate. The resolution improvement is due to each channel producing a more collimated beam of output electrons which overlaps the beams of adjacent channels to a smaller extent by the time they reach the image output phosphor screen. However it is known from measurements, for example on image intensifier tubes using such channel plates, that the resolution is lower than the ultimate resolution set by the finite spacing of the channels That is to say it is known that there is still significant overlapping of the output electron beams from adjacent channels and that further improvements in output beam collimation would have a beneficial effect on resolution.

It is an object of the invention to provide a further improvement in resolution in glass microchannel plates.

The invention provides a method of providing an output electrode on a microchannel plate comprising depositing a conducting electrode material as a layer onto an output face of the microchannel plate and into the output end of each channel, characterised in that electrode material provided by a deposition source is arranged to impinge on the output face and output end of each channel from random angles relative to the axis of each microchannel. The method may be characterised in that the deposition takes place in a vacuum chamber containing a non-reactive gas at a pressure such that the electrode material is scattered before entering the channels to provide the random angles. The non-reactive gas may be nitrogen or an inert gas such as argon may be used. Alternatively the method may be characterised in that the deposition takes place in a vacuum chamber by sputtering of the electrode material in an inert gas whereby the material is scattered before entering the channels to provide the random angles. The inert gas may be argon.

The conducting electrode material may be a mixture of nickel and chromium. Alternatively, it may be carbon or silicon.

The mechanism of the improvement in resolution when using the method in accordance with the invention is not fully understood. It is suggested that in a method in accordance with invention the gas molecules in the vacuum chamber have a thermalising effect on the molecules of the material deposited and change the distribution of velocities of the molecules of material passing from the deposition source to the channel plate surface. The thermalising effect would provide a spread of molecule speeds, a lower average speed, and also a spread of directions. The pressure of the non-reactive gas is selected in a range from above those pressures at which no effective scattering takes place to below those pressures at which the material would not reach the channel plate output face, as would be clear to those skilled in the art. The gas is selected to be non-reactive in the sense that it does not react with the channel plate materials or with the materials of the source and vacuum vessel.

It may be that the deposition method results in a layer inside the channel which is a better and more stable conductor than that obtained by geometric evaporation. This would then mean that the region at the end of each channel was more nearly field free since the layer inside the channel would be more nearly an equipotential surface. A proportion of electrons from further back in the channel strike the layer in the channel and may produce secondary electrons. If the region is field free these secondary electrons are not accelerated out of the channel and are more likely to be lost by reabsorption at the layer. Thus a higher proportion of the electrons in the final beam would be from regions further back up the channel and would be more nearly parallel to the channel axis. Also, if the material is a better conductor the region of transition from potential gradient, and hence accelerating field, to the field free region is then further back inside the channel. The transition region forms an electrostatic lens which, further back in the channel, could have a better collimating effect on the secondary electrons.

Another suggestion is that the layer as deposited by the method in accordance with the invention has a lower secondary emission coefficient and will produce fewer secondaries in the first place.

Yet another suggestion is that geometric evaporation does not give a good connection between the layer on the output face and the layer inside the channel, and that the method according to the invention improves the connection and hence allows the layer inside the channel to exert its influence to a greater extent.

The continuously tapering thickness of the layer as a function of distance into the channel may produce gradients of conduction and hence of electrostatic field which may have beneficial electron-optical effects on beam formation.

According to another aspect, the invention provides a method of providing an output electrode on a microchannel plate comprising depositing a conducting electrode material as a layer onto the output face of the microchannel plate and into the output end of each channel, characterised in that the deposition takes place by evaporation in a vacuum chamber containing a non-reactive gas. Alternatively, this aspect of the invention may be characterised in that the deposition takes place in a vacuum chamber by sputtering of the electrode material in an inert gas.

According to yet another aspect the invention provides a microchannel plate having an output electrode which extends into the output end of each channel, the output electrode comprising a conductive layer characterised in that the thickness of the conductive layer within the output end of each channel is a continuously tapering function of the distance into the channel such that the thickness decreases with increasing penetration into the channel.

The invention still further provides an image intensifier tube or a cathode ray display tube including a microchannel plate as set forth in the preceding paragraph.

The invention yet further provides an image intensifier tube D or a cathode ray display tube including a microchannel plate made by a method according to any aspect of the invention.

Figure 3:
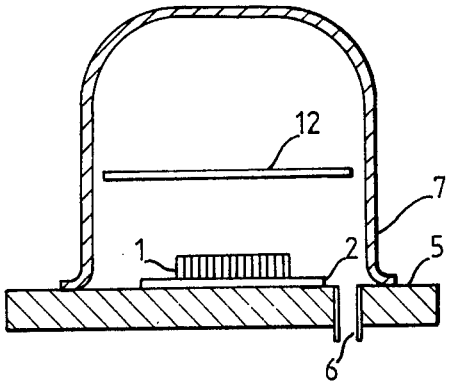
Figure 2:
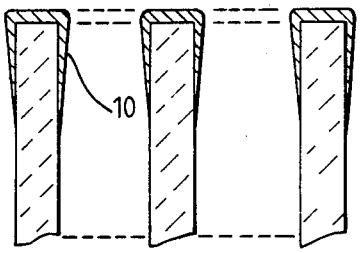
Figure 5:
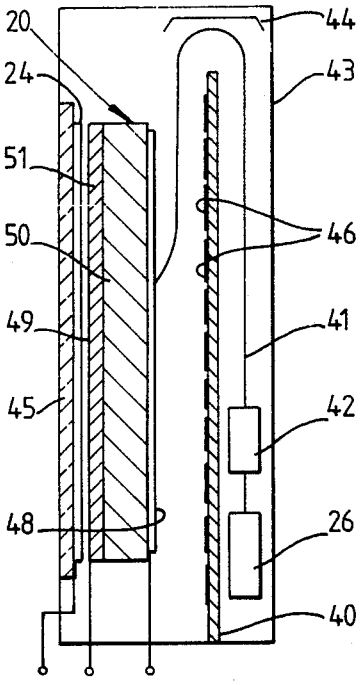
Figure 4:
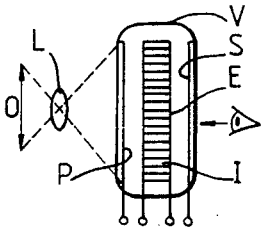

Embodiments of the invention will now be described by way of example with reference to the accompanying drawings in which FIG. 1 shows a vacuum chamber for depositing a layer of metallic electrode material on a microchannel plate output face, FIG. 2 shows a highly magnified schematic cross section of the output face of a channel plate on which an electrode layer has been deposited according to the invention, FIG. 3 shows a vacuum chamber for depositing a layer of metallic electrode material on a microchannel plate output face by sputtering, FIG. 4 shows a proximity image intensifier to which the invention is applied, and FIG. 5 shows a flat cathode ray tube having a raster intensifier to which the invention is applied.

Referring to FIG. 1, a vacuum chamber deposition apparatus for carrying out the method of the invention is shown schematically. Channel plates 1 are shown mounted on the underside of a dome 3 mounted inside the top of a vacuum bell housing 7 sealed to a base plate 5. A pumping stem 6 is provided in the base plate for vacuum pump down and for admitting a non-reactive gas as required. A deposition source 8 is provided inside the vacuum chamber comprising an electron gun 4, a magnet 9 and a crucible 11 containing the metal, typically Nichrome (Trade Mark), to be deposited. An electron beam 13 is produced by gun 4 and deflected by magnet 9 onto the metal to produce a local spot of metal at evaporation temperature. Such sources are well known in the art and will not be described further. The separation between source 8 and the channel plates 1 may be 250 mm to 300 mm for example. After vacuum pump down, a non-reactive gas, for example argon or nitrogen, is admitted at low pressure which for nitrogen may be between $1\times10^{-3}$ to $3\times10^{-3}$ Torr and the source 8 is energised. The pressure is chosen in relation to the separation between source 8 and channel plate 1 so that there are several collisions between metal atoms and gas atoms in their passage across the gap. Stated alternatively, the separation is chosen to be several mean free path lengths. Thus the metal atoms arrive at the channel plate from random angles relative to the axis of each microchannel of the plate. In addition, the action of the gas can be considered to thermalise the velocities of the metal atoms, not only randomizing their directions but also providing a lower average speed of atom and a spread of atom speeds more characteristic of a gas. The metallic electrode material is deposited as a layer onto the output face of plates 1 and into the output end of each channel. When the method according to the invention is used and a non-reactive gas at low pressure is introduced into the vacuum chamber the thickness of the layer of electrode material inside each channel is found to be a continuously tapering function of distance into each channel from the output face, the thickness decreasing with increasing penetration into the channel.

Deposition is continued until the required layer thickness is obtained. As an example, with a channel plate having channels of 12 micron diameter set at an average pitch of 15 microns, the layer on the output face would be 1600 Angstrom units, i.e. 0.16 microns. Inside the mouth of each channel the thickness is about 800 Angstrom units as compared to 150 to 200 Angstrom units as obtained by conventional geometric evaporation, tapering down in thickness into the channel. FIG. 2 shows schematically a section of the output face with the layer thickness shown much exaggerated. The thickness of the layer 10 inside the channel decreases gradually into the channel and the layer does not terminate abruptly as it would do with the known geometric evaporation method.

An alternative method of depositing the layer of metallic electrode material on the output face of the channel plate is by sputtering. FIG. 3 shows an apparatus for sputtering the layer which is a vacuum chamber as in FIG. 1 with corresponding parts numbered identically. The channel plate is in electrical connection with a table 2 on base plate 5. A plate electrode 12 made of the electrode metal to be sputtered and of larger area than the channel plate is arranged above and parallel to the channel plate. An inert gas, such as Argon, is introduced in the vacuum at, for example, a pressure of $1\times10^{-2}$ to $2\times10^{-2}$ Torr. A radio frequency arc or plasma is struck between plate 12 and the channel plate which may form part of a tuned RF circuit. Typically, the power in the plasma may be about 1 Kilowatt during sputtering. A d.c. bias may also be applied between plate 12 and the channel plate to accelerate metal ions created at plate 12 by the plasma to the channel plate. It is important that the gas ions also present should not be reactive and for this reason an inert gas, such as Argon, is preferred. Typically plate 12 may be 15 cms in diameter and spaced 5 cms from the channel plate. Again, metal ions arrive at the channel plate from random angles relative to the axis of each microchannel of the channel plate. Not only does plate 12 subtend a large solid angle at the channel plate, but there will also be collisions with the gas between plate 12 and the channel outputface which will further randomise the metal ion directions and velocities.

FIG. 4 shows a proximity image intensifier in which a microchannel plate is incorporated. A vacuum vessel V encloses a flat input photocathode P on an input window and a flat output cathodoluminescent screen S. Photocathode P and screen S are parallel and in close proximity to a flat microchannel plate electron intensifier I. A lens L is shown schematically focusing a low light level object 0 onto the photocathode P. Potentials are applied to photocathode P, across intensifier I, and to screen S so that the electron image from P is drawn directly into I where it is intensified and emerges to produce a visible image on S. A metallic electrode material is deposited as a layer E on the output face of the channel plate by the method of the invention to provide beams of electrons of improved collimation emerging from the channels of channel plate I to enhance the resolution of the image displayed on screen S.

In a typical proximity image intensifier having 12 micron diameter channels with an average pitch of 15 microns, the normal resolution obtained is 32 line pairs millimeter. In one example incorporating a microchannel plate manufactured by a method according to the invention the resolution was improved to between 40 and 42 line pairs per millimeter.

FIG. 5 shows a flat cathode ray display tube of the type disclosed in British Patent Specification No. 2101396A, corresponding to U.S. Pat. No. 4,737,690, incorporating a microchannel plate. A low voltage, low current electron beam 41 is produced by an electron gun 26 and passed upwards through a field free region established between a divider 40 and the rear wall 43 of the envelope. Line deflection means 42 are provided in the region between the divider 40 and the rear wall 43. The divider 40 does not extend the full height of the envelope and in the space provided the electron beam is reflected through 180 degrees using a trough shaped electrode 44 which is at a low voltage, for example zero volts, relative to the final anode voltage, for example 400V, of the electron gun 26. As the electron beam 41 follows a trajectory between the divider 40 and a glass channel plate electron multiplier 20 it is deflected towards the electron multiplier 20 by means of a field created between a number of substantially horizontal electrodes 46 provided on the divider 40. After current multiplication, the electron beam leaving each channel of the electron multiplier is subjected to an accelerating field to produce the required light output from the cathodoluminescent screen 24 carried by the transparent faceplate 45 of the envelope.

The electron multiplier 20 comprises a glass matrix channel plate electron multiplier having two channel plates 50 and 51 bonded in series. An electrically conducting film 48 is provided over the input side of the electron multiplier 20 to provide an input electrode to the channel plates A metallic electrode material is deposited as a layer 49 on the output face of the channel plates by a method according to the invention to enhance the resolution of the image displayed on screen 24.

From reading the present disclosure, other modifications will be apparent to persons skilled in the art. Such modifications may involve other features which are already known in the design, manufacture and use of channel plate intensifiers and component parts thereof and which may be used instead of or in addition to features already described herein. Although claims have been formulated in this application to particular combinations of features, it should be understood that the scope of the disclosure of the present application also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention. The applicants hereby give notice that new claims may be formulated to such features and/or combinations of such features during the prosecution of the present application or of any further application derived therefrom.

We claim:

1. A method of providing an output electrode on a microchannel plate comprising depositing a conducting electrode material as a layer onto an output face of the microchannel plate and into the output end of each channel, characterised in that electrode material provided by a deposition source is arranged to impinge on the output face and output end of each channel from random angles relative to the axis of each microchannel.

2. A method as claimed in claim 1 characterised in that the deposition takes place in a vacuum chamber containing a non-reactive gas at a pressure such that the electrode material is scattered before entering the channels to provide the random angles.

3. A method as claimed in claim 2 characterised in that the gas is nitrogen.

4. A method as claimed in claim 2 characterised in that the gas is argon.

5. A method as claimed in claim 1 characterised in that the deposition takes place in a vacuum chamber by sputtering of the electrode material in an inert gas whereby the material is scattered before entering the channels to provide the random angles.

6. A method as claimed in claim 5 characterised in that the inert gas is argon.

7. A method according to claim 2, wherein said pressure of said non-reactive gas is provided at a pressure in the range from above pressures at which minimal scattering of said electrode material occurs to below pressures at which said electrode material is prevented from reaching said output face of each said microchannel.

8. A method of providing an output electrode on a microchannel plate comprising depositing a conducting electrode material as a layer onto the output face of the microchannel plate and into the output end of each channel, characterised in that the deposition takes place by evaporation in a vacuum chamber containing a non-reactive gas.

9. A method as claimed in claim 8, characterised in that the gas is nitrogen.

10. A method according to claim 8, wherein said non-reactive gas is provided at a pressure ranging from above pressures at which minimal scattering of said electrode material occurs to below pressures at which said electrod material is prevented from reaching said output face of said microchannel plate.

11. A method according to claim 3 or claim 9, wherein said nitrogen is provided at a low pressure ranging between $10^{-3}$ and $3\times10^{-3}$ Torr.

12. A method as providing an output electrode on a glass microchannel plate comprising depositing a conducting electrode material as a layer into the output face of the microchannel plate and into the output end of each channel, characterized in that the deposition takes place in a vacuum chamber by sputtering of the electrode material in an inert gas.

13. A method as claimed in claim 12 characterised in that the inert gas is argon.

14. A method as claimed in claim 1 or claim 5 or claim 8 or claim 12, characterized in that the electrode material is a mixture of nickel and chromium.

15. A method according to claim 4 or claim 6 or claim 13, wherein said argon is provided at a low pressure between $10^{-2}$ to $2\times10^{-2}$ Torr.

16. A method according to claim 1 or claim 2 or claim 5 or claim 8 or claim 12, wherein said electrode material is deposited to a thickness of approximately 1600 Å on said output face, and is deposited to a thickness of approximately 800 Å inside said output end tapering down gradually into each said channel.

17. A method according to claim 16, wherein said electrode material is deposited into each output end and tapers into said channel at about the same distance.

18. A microchannel plate having an output electrode which extends into the output end of each channel, the output electrode comprising a conductive layer characterized in that the thickness of the conductive layer within the output end of each channel is a continuously tapering function of the distance into the channel such that the thickness decreases with increasing penetration into the channel, said conductive layer forming exterior surfaces of said output end of each channel and exterior surfaces within each channel.

19. An image intensifier tube comprising a microchannel plate as claimed in claim 18.

20. A cathode ray display tube having a raster intensifier comprising a microchannel plate as claimed in claim 18.

21. A microchannel plate according to claim 18, wherein said conductive layer has a thickness of about 1600 Å on said output end, and said conductive layer has a thickness of about 800 Å inside said output end of each channel and tapering into each said channel.

22. A microchannel plate according to claim 21, wherein said conductive layer tapers into each said channel at about the same distance.

* * * * *